US005768844A

United States Patent [19]

Grace, Sr. et al.

[11] Patent Number: 5,768,844

[45] Date of Patent: Jun. 23, 1998

[54] BUILDING SIDING PANELS AND ASSEMBLIES

[75] Inventors: Thomas E. Grace, Sr., Catawaba, N.C.; Douglas L. Price, Cuyahoga, Ohio

[73] Assignee: Norandex, Macedonia, Ohio

[21] Appl. No.: 767,538

[22] Filed: Dec. 16, 1996

[51] Int. Cl.[6] ..... E04D 2/20; E04D 2/30

[52] U.S. Cl. ..... 52/529; 52/539; 52/549; 52/553; 52/557

[58] Field of Search ..... 52/520, 529, 530, 52/531, 539, 546, 547, 548, 549, 553, 557

[56] References Cited

U.S. PATENT DOCUMENTS

| | | |
|---|---|---|
| 4,102,106 | 7/1978 | Golder et al. . |
| 4,186,538 | 2/1980 | Marcum, Jr. . |
| 4,187,589 | 2/1980 | Jobe, II . |
| 4,348,849 | 9/1982 | Wollam et al. . |
| 4,435,938 | 3/1984 | Rutkowski et al. . |
| 4,450,665 | 5/1984 | Katz . |
| 4,580,383 | 4/1986 | Pittman et al. . |
| 4,617,774 | 10/1986 | Pittman et al. . |
| 4,669,238 | 6/1987 | Kellis et al. . |
| 4,731,917 | 3/1988 | Krowl . |
| 4,930,287 | 6/1990 | Volk et al. . |
| 5,016,415 | 5/1991 | Kellis . |
| 5,224,318 | 7/1993 | Kemerer . |
| 5,490,359 | 2/1996 | Hepler . |
| 5,535,567 | 7/1996 | Cahoon . |

*Primary Examiner*—Christopher Kent
*Attorney, Agent, or Firm*—Finley & Berg, LLP

[57] ABSTRACT

A building siding panel and assembly each assembly having a plurality of interconnecting siding panels that are attached to the building using fasteners that are driven into the building through a plurality of aligned and spaced apart slot pairs in a uniform manner that reduces the distortion that accompanies thermal expansion and/or contraction of the siding material.

10 Claims, 2 Drawing Sheets

BUILDING SIDING PANELS AND ASSEMBLIES

BACKGROUND OF THE INVENTION

The present invention relates to building siding panels, particularly those made from thermoplastic "vinyl" materials such as polyvinylchloride (PVC) that are extruded into a predetermined shape and size. In securing vinyl siding to walls of residential or commercial building structures, installers must often take into account the inherent expansion and contraction properties of the material used when that material is subjected to temperature fluctuations. It has become understood that when the siding is secured flush to a wall with nails, staples or other fasteners, the natural expansion and contraction of the vinyl material is impeded, thereby resulting in an unsightly rippling distortion commonly known as "oil-canning." With conventional siding, in order to prevent the oil-canning effect, the installer must allow for a slight clearance between the fastener (e.g. nail) head and the portion of the siding (i.e. nailing hem) through which the fastener extends in securing the panel to the wall. This is often difficult to achieve given the ease by which fasteners are driven too tightly, even by professional siding installers. In other conventional siding structures where fastening is achieved by staples, installers resort to installing one staple leg into a nail slot in the body of the siding, while the other staple leg is driven over an edge of the siding nail hem into a wall. Those structures similarly are disadvantageous since driving the staple over the nailing hem often results in flush fastening of the staple to the wall, the hem (or both), and the accompanying oil-canning problem described above. That installation also results in uneven fastening. Alternatively, the installer to avoid flush fastening undesirably drives the staple in at an angle which often results in either an insecure installation, oil-canning, or both.

There have been a number of structures described that attempt to overcome the inherent oil-canning distortion that accompanies the use of thermoplastic materials for siding. For example U.S. Pat. No. 4,102,106 discloses the use of parallel ridges on the surface of the nailing hem portion of the siding to prevent a nail from being driven flush with the hem. U.S. Pat. No. 4,617,774 illustrates the use of a removable protrusion to combat oil-canning that acts as a spacer between adjacent panels during installation and once removed enables free movement between the interlocking panels that have been exposed to weather changes. Guide ribs on the surface of the nailing hem are also disclosed to guide a nail which secures the panel. Similarly, U.S. Pat. No. 4,580,383 describes a stop on a locking strip that may be fractured to allow movement between adjacent panels in the event of thermal expansion. U.S. Pat. No. 5,224,318 describes longitudinally aligned and horizontally elongated mounting slots having a vertical length that is wider than the shank of a nail yet narrower than the nail head to prevent flush (tight) fastening. Each slot is placed in a recessed region between two flat ridges that prevent a hammer head from entering the region and thereby avoids flush fastening. Likewise, U.S. Pat. Nos. 4,669,238, 4,930,287, 4,435,938, and 5,535,567 show a series of longitudinally aligned horizontally elongated slots in a recessed section to accommodate and relieve thermal expansion and contraction of the panels. U.S. Pat. Nos. 4,186,538, 4,348,849, 4,930,287, and 4,450,665 similarly use longitudinally aligned elongated slots.

U.S. Pat. Nos 4,731,917 and 4,187,589 disclose the use of staples to fasten the siding, with one staple leg being driven beyond the edge of the siding while the other staple leg extends through a slot in the siding.

U.S. Pat. No. 5,016,415 describes a panel strip having a number of rows of longitudinally aligned horizontally elongated slots. U.S. Pat. No. 5,490,359 fastens siding to a metal building using a screw that is placed through flanges.

While the foregoing references describe various assemblies that are said to minimize oil-canning, they do not provide, a relatively inexpensive and readily extruded assembly that may be installed uniformly and quickly using a staple gun without concern that the staples will provide an uneven, insecure or overly tight installation.

It is an object of the present invention to provide an improved extruded thermoplastic siding panel that may be readily and uniformly fastened along with interlocking adjacent panels to a building structure in a manner that minimizes the oil-canning that results from thermal expansion and/or contraction of the panel.

It is a further object of the present invention to provide such a panel which may be installed with either nails or staples without the conventional disadvantages that have accompanied either fastening method.

In accordance with the present invention, a siding panel to be attached to a building substrate is provided with a hem attaching portion near the upper end of the panel body, said hem attaching portion being generally parallel to the wall, and having a plurality of horizontally spaced-apart slot pairs, each said pair comprising an upper slot and a lower slot that are vertically aligned and spaced apart in relation to each other. The siding is fastened to the substrate using fasteners that are driven into each slot. When staples are used as the fastener, each of the two staple legs extend through the upper and lower slots of a slot pair, respectively. Extending upwardly from the hem portion is a C-shaped curl section having a vertically oriented flat edge that is generally parallel to both the hem attaching portion and the substrate and spaced part from the substrate. The C-shaped portion serves as a guide for the fastening means and prevents fasteners from being driven flush, or at an angle into the slots. Adjacent panels interlock using conventional locking assemblies wherein a flange portion near the lower end of a panel engages a generally U-shaped portion that may be below the hem portion of an adjacent panel.

DETAILED DESCRIPTION OF THE INVENTION

Panels of the present invention may be constructed of any suitable material that imparts rigidity, with panels manufactured from thermoplastic materials and in particular, polyvinyl chloride (PVC) preferred. The panels are constructed using conventional postform extruding techniques that involve forming an extrudate by melting a blend of the powdered thermoplastic resin (e.g. polyvinyl chloride) and conventional performance additives that impart weatherability, impact resistance and processing features. In this regard, twin screw extruders may be used to melt the blend to form a extrudate that is then extruded through a sheet die to form a flat sheet of uniform width and thickness. The sheet is then pulled through calibration dies to mold the panel into the final shape described above. The panel is then water cooled to set the form.

Figure 1:
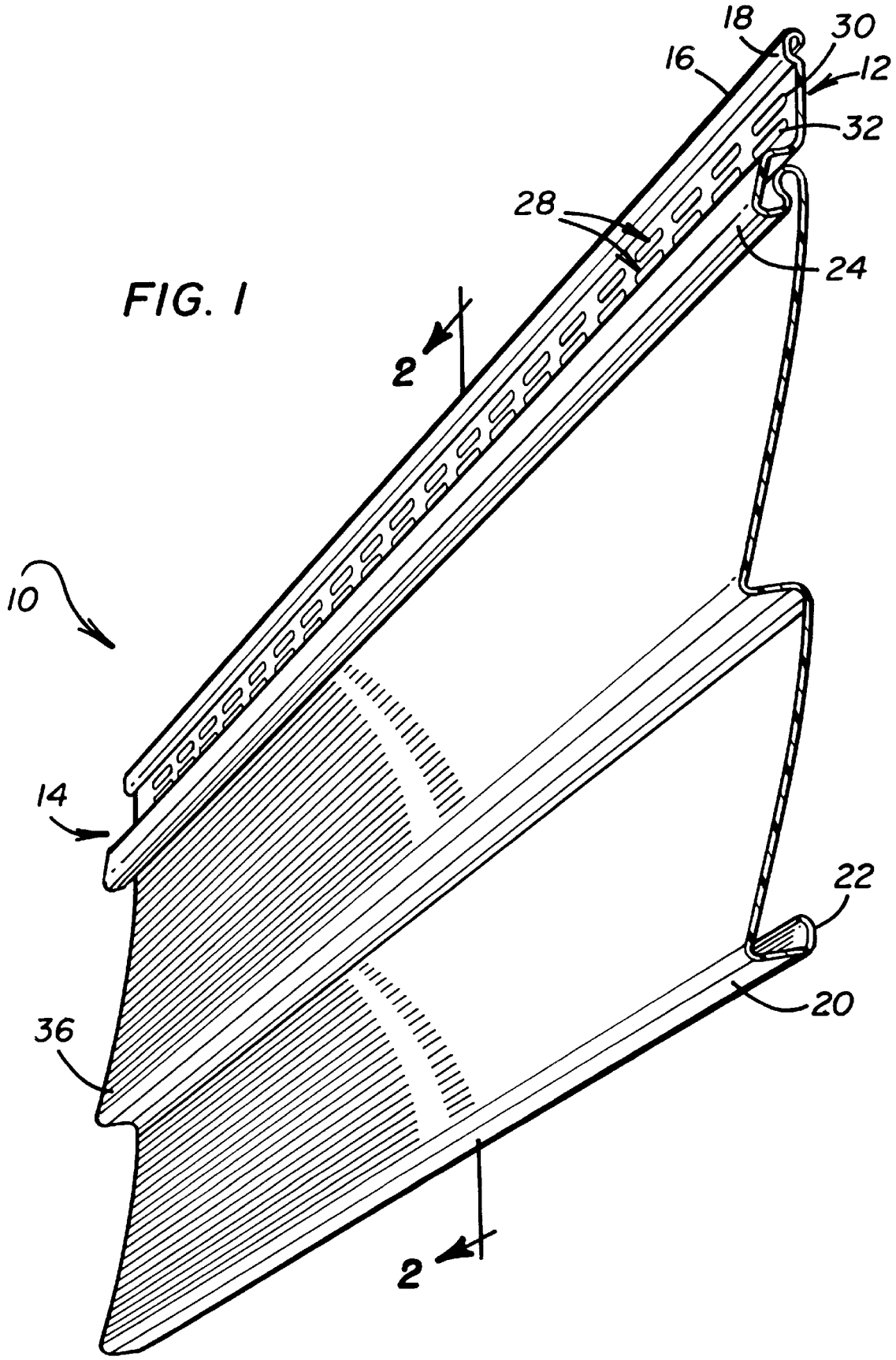
FIG. 1 is an isometric view of a siding panel in accordance with the present invention.
Figure 2:
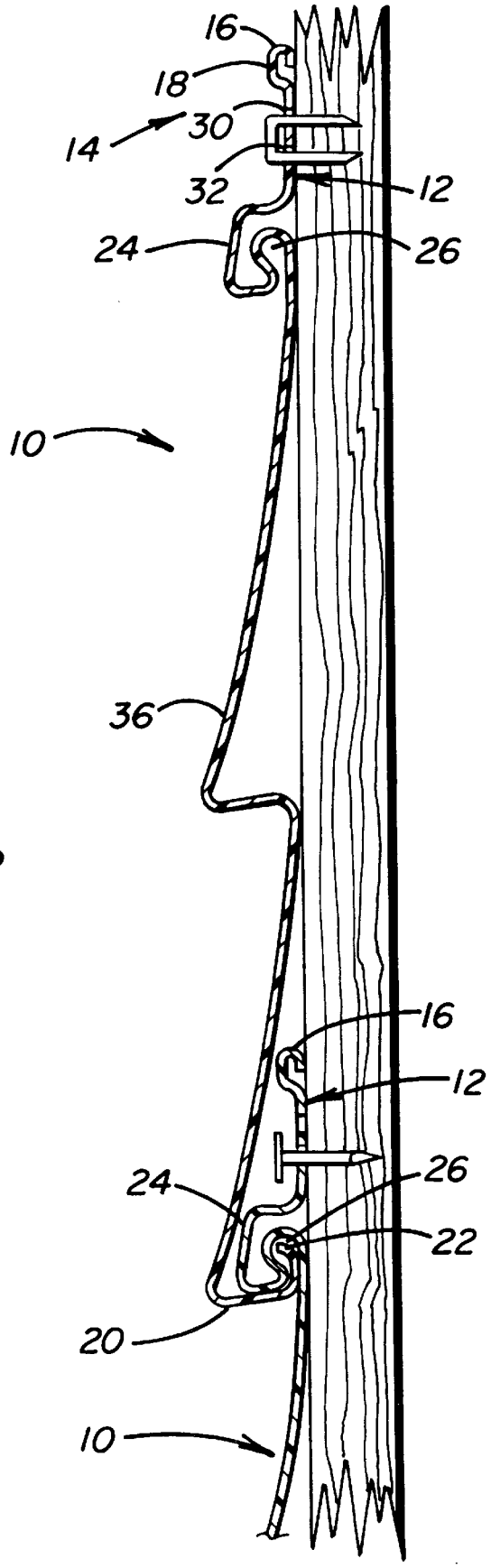
FIG. 2 is a vertical sectional view taken along line 2—2 of FIG. 1 depicting the interlocking of two adjacent panels and the fastening thereof to a building substrate in accordance with the present invention.

With reference to FIGS. 1 and 2, each of the integrally formed upper and lower panels 10 have hem attaching portion 12 near the upper end 14 of said panel, said upper end 14 including a C-shaped curl portion 16 having vertically oriented edge 18. At the lower end of each panel 10 is a flange portion 20 that terminates with an upwardly extending lip 22. Just below hem attaching portion 12 of upper panel 10 is a generally U-shaped portion 24 that defines open area 26 for receiving extending lip 22 of an adjacent lower panel 10 with flange portion 20 of the lower panel engaging the U-shaped portion 24 of the upper panel in interlocking relation. Hem attaching portion 12 includes a plurality of horizontally spaced apart slot pairs 28, each pair consisting of an upper slot 30 and a lower slot 32 that are vertically aligned and spaced apart from each other to enable an installer to drive a staple therethrough, with each staple leg driven through each slot of the slot pair, respectively, into building substrate 34. C-shaped curl portion 16 acts as a guide for the installer by maintaining the fastening means, e.g., staple gun, hammer or other conventional fastening means, at a sufficient distance from the hem to prevent flush installation of the fastener and allow uniform installation of fasteners in each successive slot pair. Uniformity is maintained as a result of the C-shaped curl portion which keeps constant the separation between the hem and fastening means for each successive slot pair. In doing so, the outermost portion of the fastener (e.g., nail head) is substantially coplanar with edge 16 of the C-shaped curl.

When staples are used, they are not driven into the hem in an excessively tight (flush) manner. Thus, the panels are able to move relative to the staples when thermal expansion and contraction occur, thereby reducing distortion or oil-canning. Suitable staples are 16-gauge with a 7/16 inch crown and 1-½ inches long.

The above-described hem and curl design is intended to be used with any conventional panel assembly. Thus, the assembly depicted in FIGS. 1 and 2, particularly the form for the slopingly extending middle portions 36 of the panel, is only one of many suitable assemblies that can be used in conjunction with the hem and curl design of the present invention.

Similarly, the dimensions of the slots and spacing between upper and lower slots of a slot pair and between adjacent slot pairs will vary depending on the particular siding assembly used. In one preferred hem and curl assembly, each slot has a length (in horizontal direction) of 1.190 inches and a width (in vertical direction) of 0.144 inches, a spacing between slots (in each slot pair) of 0.397 inches, and a horizonal spacing between adjacent slot pairs of 0.272 inches. While the slots are preferably elongated and in horizontal orientation, particularly when nails are used as fasteners, all shapes and orientations that enable uniform and non-flush fastening are suitable.

While the hem and curl assembly of the present invention is most preferably installed with staple fastening means due to the ease and quickness of such installation, the use of nails or other fasteners that may be driven through the slots is suitable. In this regard, the curl 16 maintains a distance between a hammer head and attaching hem portion 12, which prevents a nail from being driven too tightly into (or flush with) the hem. In instances where nails are used, the slots should be wide enough to receive a nail shank yet narrower than the nail head.

While the present invention has been described with reference to the embodiments described above, the foregoing description is illustrative only and various changes in the size, shape, materials, and construction may be made without departing from the spirit of the invention.

What is claimed is:

1. An elongated siding panel to be attached to a building substrate, comprising:

an elongated body having an inner face and an outer face, an upper end, and a lower end, said body having a vertically oriented hem attaching portion near said upper end, said hem attaching portion having a plurality of horizontally spaced-apart slot pairs, each said slot pair having an upper slot and a lower slot that are vertically aligned and spaced apart in relation to each other, said upper and lower slots extending through the body to allow a fastener to be driven therethrough;

a C-shaped portion at the upper end of the body extending above said hem attaching portion, said C-shaped portion having a vertically oriented flat edge that is generally parallel to the hem attaching portion.

2. The panel of claim 1, wherein said body further comprises a flange portion at the lower end of the body, said flange portion having a lip section upwardly extending therefrom;

and a generally U-shaped tongue portion extending outwardly from said body.

3. The panel of claim 2 wherein the U-shaped tongue portion extends from the body at a position on the body below said hem attaching portion.

4. The panel of claim 3 wherein each slot in each slot pair is horizontally elongated.

5. The panel of claim 4 wherein the panel is of an extruded thermoplastic material.

6. A siding panel assembly to be attached to a building substrate, comprising:

a plurality of elongated panels, each panel having an elongated body having an inner face and an outer face, said body having a vertically oriented hem attaching portion near an upper end of the body, said hem attaching portion having a plurality of horizontally spaced-apart slot pairs, each said slot pair having an upper slot and a lower slot that are vertically aligned and spaced apart in relation to each other, said upper and lower slots extending through the body to allow a fastener to be driven therethrough;

fastener means for driving a fastener through a plurality of said slots;

each panel further comprising a flange portion at a lower end of the body, said flange portion having a lip section upwardly extending therefrom, and a generally U-shaped tongue portion extending outwardly from said body, the flange and extending lip portion near the lower edge of the body of the panel adapted to engage in interlocking fashion the generally U-shaped tongue portion from an adjacent panel.

7. The panel assembly combination of claim 6 wherein each panel further comprises a C-shaped portion at the upper end of the body extending above said hem attaching portion, said C-shaped portion having a vertically oriented flat edge that is generally parallel to the hem attaching portion, said vertically oriented flat edge being substantially coplanar with the outermost portion of each fastener driven through each slot.

8. An elongated siding panel in combination with a building substrate, comprising:

an elongated body having an inner face which faces said substrate, an outer face which faces away from the substrate, an upper end, and a lower end, said body having a vertically oriented hem attaching portion near said upper end, said hem attaching portion being generally parallel to the substrate and having a plurality of horizontally spaced-apart slot pairs, each said slot pair having an upper slot and a lower slot that are vertically aligned and spaced apart in relation to each other, said upper and lower slots extending through the body to allow a fastener to be driven therethrough and into the substrate; and fastener means driven through a plurality of said upper or lower slots and into the substrate, each said fastener means comprising at least one leg and an upper head portion, such that a portion of each leg of the fastener means is embedded within said substrate and spacing is left between each upper head portion of said fastener means and the outer face of the body.

9. The elongated siding panel in combination with a building substrate of claim 8 wherein each said fastener means is a staple having two legs, and wherein said fastener means are used to attach said panel assembly to said substrate by, for each slot pair, driving one leg of said staple through the upper slot of the slot pair and driving the other leg through the lower slot of the slot pair.

10. The elongated siding panel in combination with a building substrate of claim 9 wherein each slot in each slot pair is horizontally elongated.

* * * * *